US009623544B2

(12) United States Patent
Yang et al.

(10) Patent No.: US 9,623,544 B2
(45) Date of Patent: Apr. 18, 2017

(54) SPRING BIASED LEVER FOR OPENING A MOVEABLE MEMBER OF AN ADAPTER FOR A FLOORING NAIL GUN

(71) Applicant: TAIZHOU DAJING INDUSTRY CO., LTD., Taizhou, Zhejiang (CN)

(72) Inventors: Mingjun Yang, Taizhou (CN); Zaijun Zhu, Taizhou (CN); Qinling Ying, Taizhou (CN)

(73) Assignee: TAIZHOU DAJING INDUSTRY CO., LTD, Taizhou, Zhejiang Province (CN)

( * ) Notice: Subject to any disclaimer, the term of this patent is extended or adjusted under 35 U.S.C. 154(b) by 0 days.

(21) Appl. No.: 14/363,812

(22) PCT Filed: May 14, 2013

(86) PCT No.: PCT/CN2013/075583
§ 371 (c)(1),
(2) Date: Jun. 9, 2014

(87) PCT Pub. No.: WO2014/169500
PCT Pub. Date: Oct. 23, 2014

(65) Prior Publication Data

US 2016/0023343 A1 Jan. 28, 2016

(30) Foreign Application Priority Data

Apr. 16, 2013 (CN) ..... 2013 1 0132702

(51) Int. Cl.
*B25C 5/16* (2006.01)
*B25C 7/00* (2006.01)
*B25C 1/00* (2006.01)

(52) U.S. Cl.
CPC ..... *B25C 7/00* (2013.01); *B25C 1/00* (2013.01); *B25C 5/1665* (2013.01); *B25C 5/16* (2013.01)

(58) Field of Classification Search
CPC .. B25C 1/00; B25C 1/06; B25C 1/005; B25C 7/00; B25C 7/13; B25C 13/00;
(Continued)

(56) References Cited

U.S. PATENT DOCUMENTS 4,436,236 A * 3/1984 Jobe ..... B25C 5/1665 227/123
4,467,952 A * 8/1984 Morrell, Jr. ..... B25C 5/1665 227/120
(Continued)

FOREIGN PATENT DOCUMENTS

CN 2750898 Y 1/2006
CN 201483458 U 5/2010
(Continued)

OTHER PUBLICATIONS

State Intellectual Property Office of the P.R. China (ISR/CN), "International Search Report for PCT/CN2013/075583", China, Jan. 30, 2014.

*Primary Examiner* — Scott A. Smith
(74) *Attorney, Agent, or Firm* — Tim Tingkang Xia, Esq.; Locke Lord LLP

(57) ABSTRACT

An adapter for a flooring nail gun is provided with a muzzle member including at least one set of two inclined cavities; a moveable member including at least one set of two inclined protrusions at an end, the inclined protrusions being disposed in the inclined cavities; and a quick releasing device disposed on the inclined protrusions. The quick releasing device includes a pressing member, a spring member, and a lever, and wherein the pressing member and the muzzle member are joined, the lever and the pressing member are pivotably secured together, and the spring member has one end anchored at the pressing member and the other end pivotably secured to the lever. The moveable
(Continued)

member can be opened for troubleshooting in case of malfunction.

9 Claims, 3 Drawing Sheets

(58) Field of Classification Search
CPC .. B25C 5/00; B25C 5/16; B25C 1/008; B25C 5/1665; B25C 5/1637; B25C 5/1668; B25C 5/1675; B25C 5/1696; E04F 21/22
USPC ..... 227/120, 109, 148, 123, 127, 128, 8
See application file for complete search history.

(56) References Cited

U.S. PATENT DOCUMENTS 4,641,772 A * 2/1987 Skuthan ..... B25C 5/1665 227/123
5,642,849 A * 7/1997 Chen ..... B25C 5/1665 227/123
6,056,182 A * 5/2000 Chen ..... B25C 5/1665 227/123
6,076,722 A * 6/2000 Huang ..... B25C 5/1665 227/123
6,318,618 B1 * 11/2001 Jen ..... B25C 5/1665 227/123
6,325,268 B1 * 12/2001 Liang ..... B25C 5/1665 227/123
6,409,068 B1 * 6/2002 Lee ..... B25C 5/1665 227/123
6,598,776 B2 * 7/2003 Adachi ..... B25C 5/1665 227/123
6,641,020 B1 * 11/2003 Yao ..... B25C 1/005 227/109
6,763,989 B2 * 7/2004 Wang ..... B25C 1/005 227/109
7,083,074 B2 * 8/2006 Chen ..... B25C 5/1665 227/120
8,091,752 B2 * 1/2012 Jian ..... B25C 1/005 227/119
2002/0030079 A1 3/2002 Adachi et al.
2003/0222116 A1 * 12/2003 Chen ..... B25C 5/1665 227/139

FOREIGN PATENT DOCUMENTS

CN 102979296 A 3/2013
CN 203257066 U 10/2013

* cited by examiner

SPRING BIASED LEVER FOR OPENING A MOVEABLE MEMBER OF AN ADAPTER FOR A FLOORING NAIL GUN

BACKGROUND OF THE INVENTION

1. Field of the Invention

The invention relates to wood flooring installation devices and more particularly to a spring biased lever capable of opening a moveable member of an adapter for a flooring nail gun in case of malfunction.

2. Description of Related Art

Flooring nail guns are widely used for wood flooring installation. A launched nail is required to overcome resistance from a wood strip and a subfloor in order to fasten them together in use. The resistance is especially greater when the nail is about to reach its desired position. A vertical fraction of the driving force of the nail can displace a moveable member, resulting in failure of nailing. Typically, nails are mounted on long strips. Thus, an operator has to find a tool to solve the malfunctioned moveable member. However, it could be time consuming, bothersome and even unsuccessful.

Thus, the need for improvement still exists.

SUMMARY OF THE INVENTION

It is therefore one object of the invention to provide an adapter for a flooring nail gun, which comprising:

a muzzle member including at least one set of two inclined cavities;

a moveable member including at least one set of two inclined protrusions at an end, the inclined protrusions being disposed in the inclined cavities; and a quick releasing device disposed on the inclined protrusions;

wherein the quick releasing device comprises a pressing member, a spring member, and a lever; and wherein the pressing member and the muzzle member are joined, the lever and the pressing member are pivotably secured together, and the spring member has one end anchored at the pressing member and an other end pivotably secured to the lever.

Preferably, the quick releasing device comprises a pressing member, a spring member, and a lever, and wherein the pressing member and the muzzle member are joined, the lever and the pressing member are pivotably secured together, and the spring member has one end anchored at the pressing member and the other end pivotably secured to the lever.

Preferably, the at least one set of two inclined protrusions is one set of two inclined protrusions and the at least one set of two inclined cavities is one set of two inclined cavities.

Preferably, wherein the inclined protrusions are inclined upward, and wherein the inclined cavities are inclined downward.

Preferably, the moveable member further includes a pivot, and wherein the lever including a transverse hole pivotably put on the pivot.

Preferably, the pressing member includes two parallel protuberances, and wherein the moveable member includes two inclined projections at the other end, the inclined projections being engaged the protuberances.

Preferably, the spring member is either a coil spring or a torsion spring.

Preferably, the lever is lower than a top of the moveable member or flush with the top of the moveable member in operation.

Preferably, further comprising an exit formed by both the muzzle member and the moveable member, the exit having a trapezoidal section.

Preferably, the pressing member includes two parallel spaced hooks, and wherein the spring member has one end anchored at the parallel spaced hooks.

By utilizing the invention the following advantages are obtained: The moveable member can be quickly opened in case of malfunction due to complimentary engagement of the moveable member and the muzzle member, the complimentary engagement of the pressing member and the moveable member, and the spring biased lever. Repair time can be decreased greatly. Finally, success can be ensured.

The above and other objects, features and advantages of the invention will become apparent from the following detailed description taken with the accompanying drawings.

DETAILED DESCRIPTION OF THE INVENTION

Figure 1:
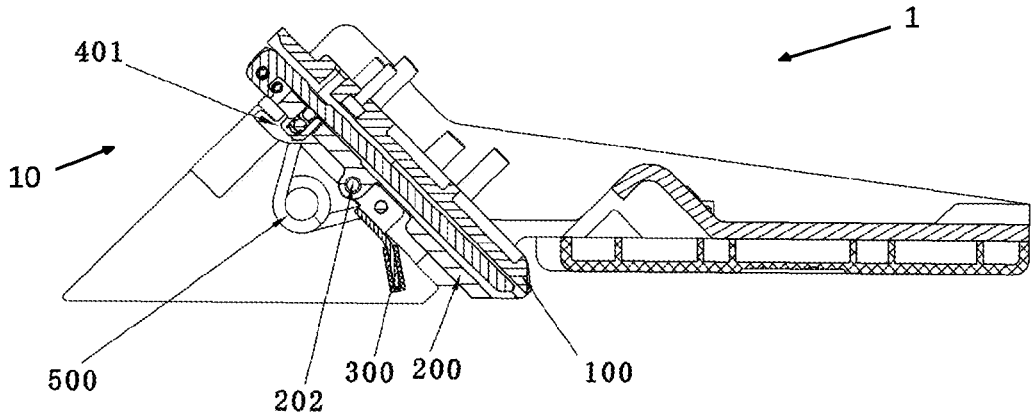
FIG. 1 is a side elevation in part section of an adapter for a flooring nail gun according to the invention.
Figure 2:
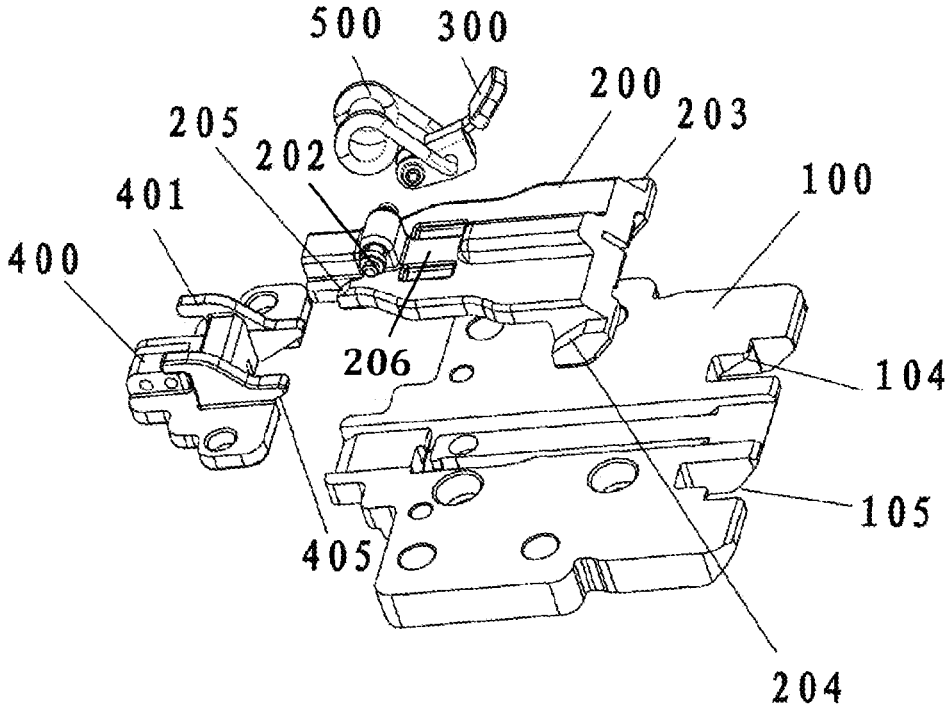
FIG. 2 is an exploded view of major components of the adapter.

Referring to FIGS. 1 to 5, an adapter 1 for a flooring nail gun 5 in accordance with the invention comprises the following components as discussed in detail below.

A muzzle member 100 and a moveable member 200 are provided. The muzzle member 100 includes two inclined cavities 104, 105 at one edge. The moveable member 200 includes a pivot 202, two inclined protrusions 203, 204 at an end, two inclined projections 205 at the other end, and a recess 206 on an intermediate portion of a top. The cavities 104, 105 are inclined downward. The inclined protrusions 203, 204 are complimentarily disposed in the inclined cavities 104, 105 to join the moveable member 200 and the muzzle member 100.

A quick releasing device 10 of the adapter 1 comprises a pressing member 400 including two parallel spaced hooks 401 and two parallel protuberances 405 opposite to the hooks 401; a spring member (e.g., coil spring or torsion spring) 500 having one end anchored at the hooks 401; and a lever 300 including a transverse hole pivotably put on the pivot 202. The lever 300 is pivotably secured to the other end of the spring member 500 and has a bottom 301 urging against the recess 206 of the moveable member 200. The protuberances 405 of the pressing member 400 are complimentarily engaged the projections 205 of the moveable member. Both the pressing member 400 and the muzzle member 100 are fixed (joined) together, but the pressing member 400 and the muzzle member 100 are not integrally formed, as specifically shown in FIG. 2.

A wood strip 2 is to be secured onto a subfloor 3 by launching nails from the flooring nail gun 5 which has the adapter 1 mounted thereto. An exit 4 of the adapter 1 is formed by both the muzzle member 100 and the moveable member 200 and is in close proximity to the strip 2. It is understood that the exit 4 is required to target an edge of the strip 2. Otherwise, a desired fastening of the strip 2 and the subfloor 3 can be compromised. Thus, the exit 4 has a trapezoidal cross-sectional shape and a width as small as possible so as to precisely target an edge of the strip 2.

Figure 3:
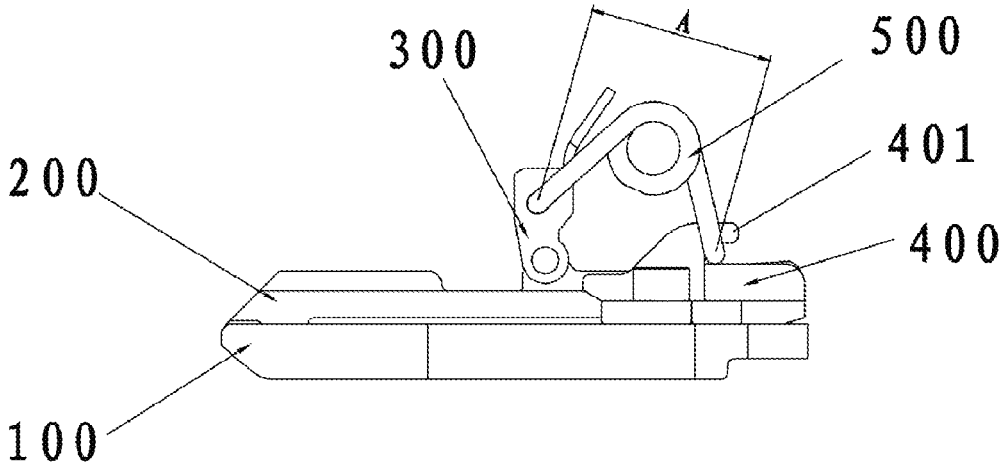
FIG. 3 is a side elevation showing the adapter in an inoperative position.
Figure 4:
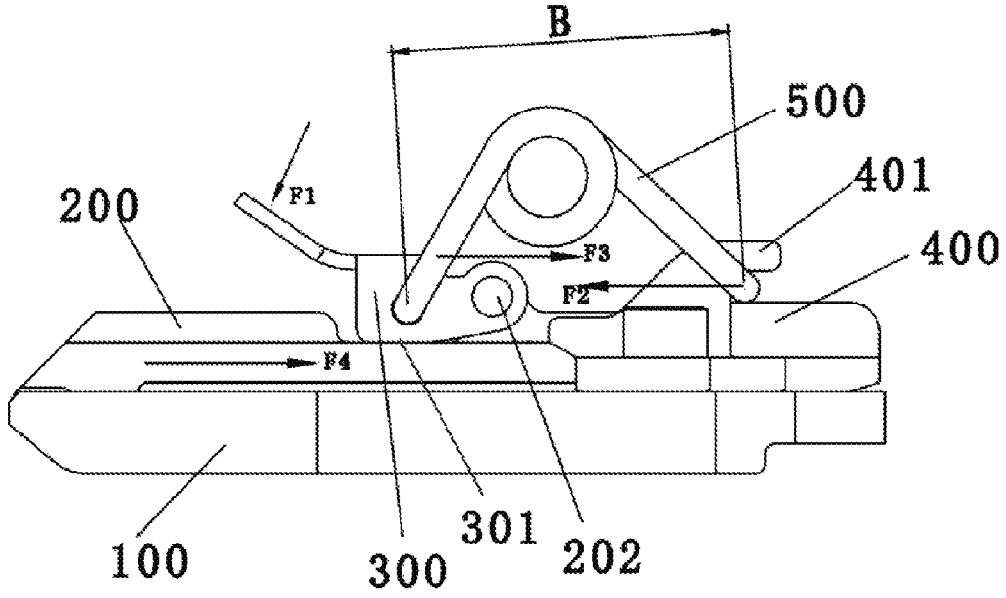
FIG. 4 is a view similar to FIG. 3 showing the lever being pivoted counterclockwise to energize a spring in use.

As shown in FIGS. 3 and 4, the spring member 500 is secured to the hooks 401 of the pressing member 400. Alternatively, the spring member 500 is integrally formed with the hooks 401 of the pressing member 400. Still alternatively, the hooks 401 are eliminated and the spring member 500 is integrally formed with the pressing member 400.

In addition to coil spring or torsion spring, the spring member 500 can be another form of spring in other embodiments. Further, the spring member 500 is shaped as V.

Figure 5:
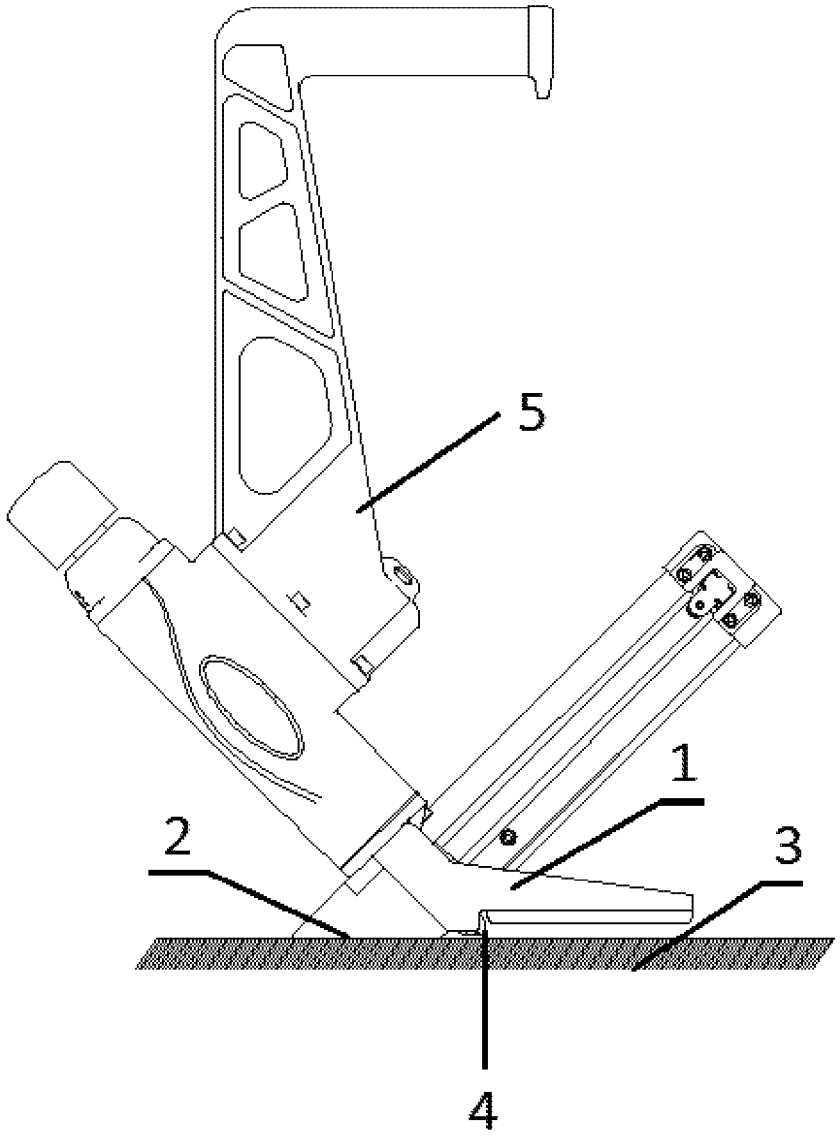
FIG. 5 is a side elevation of a flooring nail gun with the adapter of the invention mounted thereon.

As shown in FIG. 5, the flooring nail gun 5 stands upright. For preventing the strip 2 from being damaged, the adapter 1 is slightly above the strip 2. Further, the lever 300 is lower than the top of the moveable member 200 or flush with the top of the moveable member 200 in operation.

In case of malfunction, operations of the invention are discussed in detail below (see FIGS. 3 and 4). A distance between both ends of the spring member 500 is designated by A. An operator may clockwise turn the lever 300 (as indicated by arrow F1). Both the pressing member 400 and the muzzle member 100 are fixed. Thus, one end of the spring member 500 may exert a compression force (as indicated by arrow F2) toward the other end thereof. Likewise, the other end of the spring member 500 may exert a compression force (as indicated by arrow F3) toward one end thereof. At this position, the distance between both ends of the spring member 500 is designated by B which is greater than A. Further a force (as indicated by arrow F4) is exerted on the moveable member 200 to move it toward the pressing member 400. A release of the force F1 will return the lever 500 to its inoperative position. At this position, the distance A is equal to the distance B. Thereafter, the operator may open the moveable member 200 of the adapter 1 to solve the problem.

While the invention has been described in terms of preferred embodiments, those skilled in the art will recognize that the invention can be practiced with modifications within the spirit and scope of the appended claims.

What is claimed is:

1. An adapter for a flooring nail gun comprising:

a muzzle member including at least one set of two inclined cavities;

a moveable member including at least one set of two inclined protrusions at an end, the inclined protrusions being disposed in the inclined cavities, and two inclined projections at an opposite end; and a quick releasing device comprising a pressing member, a spring member, and a lever, wherein the pressing member and the muzzle member are joined, the lever and the pressing member are pivotably secured together, and the spring member has one end anchored at the pressing member and the other end pivotably secured to the lever, wherein the pressing member comprises two parallel protuberances being complimentarily engaged with the inclined projections of the moveable member, wherein the pressing member and the muzzle member are not integrally formed.

2. The adapter for a flooring nail gun of claim 1, wherein the at least one set of two inclined protrusions is one set of two inclined protrusions and the at least one set of two inclined cavities is one set of two inclined cavities.

3. The adapter for a flooring nail gun of claim 2, wherein the inclined protrusions are inclined upward, and wherein the inclined cavities are inclined downward.

4. The adapter for a flooring nail gun of claim 3, wherein the moveable member further includes a pivot, and wherein the lever including a transverse hole pivotably put on the pivot.

5. The adapter for a flooring nail gun of claim 1, wherein the spring member is a coil spring.

6. The adapter for a flooring nail gun of claim 1, wherein the spring member is a torsion spring.

7. The adapter for a flooring nail gun of claim 1, wherein the lever is lower than a top of the moveable member or flush with the top of the moveable member in operation.

8. The adapter for a flooring nail gun of claim 1, further comprising an exit formed by both the muzzle member and the moveable member, the exit having a trapezoidal cross-sectional shape.

9. The adapter for a flooring nail gun of claim 1, wherein the pressing member includes two parallel spaced hooks, and wherein the spring member has one end anchored at the parallel spaced hooks.

* * * * *